United States Patent [19]

Maher et al.

[11] 4,016,525

[45] Apr. 5, 1977

[54] GLASS CONTAINING RESISTOR HAVING A SUB-MICRON METAL FILM TERMINATION

[75] Inventors: John P. Maher, Adams; Theodore W. Johnson, Williamstown, both of Mass.

[73] Assignee: Sprague Electric Company, North Adams, Mass.

[22] Filed: Nov. 29, 1974

[21] Appl. No.: 528,052

[52] U.S. Cl. ..... 338/309; 338/308; 338/328

[51] Int. Cl.[2] ..... H01C 1/012

[58] Field of Search ..... 338/308, 309, 262, 328; 117/217

[56] References Cited

UNITED STATES PATENTS

| | | | |
|---|---|---|---|
| 3,370,262 | 2/1968 | Marty | 338/309 |
| 3,434,877 | 3/1969 | Degenkolb | 338/309 |

OTHER PUBLICATIONS

Shih "Improved Silver–Palladium Termination Metallization for Thick Film Resistors" in Int. Micro. Symp., Boston, Mass, 10/23/74, pp. 35–37 (copy in file).

Kuo "Electrical Applications of Thin Films Produced by Metallo Organic Deposition" in Int. Micro. Symp., San Francisco, Cal., 10/22/73, pp.4A–21–4A–7–8.

Miller, "Thick Film Technology & Chip Joining" Gordon & Breach, N.Y., 1972, pp. 73 & 74.

*Primary Examiner*—E. A. Goldberg

*Attorney, Agent, or Firm*—Connolly and Hutz

[57] ABSTRACT

A cermet resistor employs film terminations of submicron thickness. The terminations contain particles of $SiO_2$ or $MnO_2$ that may be conveniently made by mixing such particles in a metal resinate paste, screening the paste on a glazed or unglazed substrate and firing. A glass containing resistor paste is screened in overlapping relationship with the fired terminations and is itself fired. The particle additives ameliorate cracking of the terminations at resistor firing and enhance the termination to substrate bond.

7 Claims, 3 Drawing Figures

GLASS CONTAINING RESISTOR HAVING A SUB-MICRON METAL FILM TERMINATION

BACKGROUND OF THE INVENTION

This invention relates to electrical resistors having a glass-containing resistor film and more particularly to such resistors wherein the film lies in overlapping contact with metal film terminations of sub-micron thickness. The term sub-micron as used herein means thicknesses less than one micron and such sub-micron thick films are typically made by the well known process of metallo-organic deposition as is described and defined in a paper presented at the International Microelectronics Symposium, October 22–24, 1973, in San Francisco, (pp 4A 7–1 to 4A 7–8) by C. Y. Kuo entitled Electrical Applications of Thin-Films Produced by Metallo Organic Deposition.

Film resistors are commonly formed on an alumina substrate and typically serve as a part of a hybrid integrated circuit all of which is formed and interconnected on a single substrate.

Resistor films containing a noble metal conductive component are well known for their relatively inert and stable properties. They are often formed by a process that includes applying to a substrate a coating of a noble metal resinate paste and heating to decompose the resinate and form a noble metal/noble metal oxide resistor film. Such resinate derived resistor films are normally deposited in overlapping relationship with two or more conductive film terminations, which terminations have also been formed from noble metal resinates. The resistor, including terminations is usually though not always formed on a glazed ceramic substrate. Such glaze is called underglaze and serves to provide a smooth high melting temperature glass surface that does not substantially soften during the firing of the overlying components and which helps to assure predictable and high quality resistors that are formed thereon.

Resistor films may alternatively consist of a matrix of metal particles and glass. Such glass containing resistor films are generally orders of magnitude thicker than exclusively resinate derived films. Glass containing film resistor systems are generally capable of providing higher sheet resistivities, and tend to exhibit tight tolerances of temperature coefficient of resistance (TCR). Such glass containing film resistor systems are often preferred for these reasons.

It is well known that glass and metal particle containing conductive films must have a thickness greater than about 1.5 microns, since any attempt to reduce the film thickness by any means results in discontinuous nonconducting films. Such films are generally from 10 to 30 microns thick.

It is conventional to employ glass containing film terminations that provide strong termination substrate bonds for glass containing film resistors, even though it is well known that sub-micron thick film terminations containing only metals and/or metal oxides can be substantially more economical due to their relative thinness and high bulk conductivity. Much less metal is required in the equivalent termination. Such terminations, however, generally have a relatively poor bond to the underlying substrate and also contain high residual stresses. When an overlapping glass containing resistor film, typically containing a low temperature glass component, is subsequently formed, the low temperature glass components of the adjacent resistor system reacts at firing with the underglaze, lowering its melting point in the vicinity of the resistor-termination interface. It has been observed that the molten resistor glass either penetrates or moves underneath the thin-film termination of the region of overlap. The fluxing action of the resistor glass during the firing of the resistor film releases the termination from a glazed or unglazed ceramic substrate and allows the termination to shrink. This fluxing action is also effective in debonding the terminations of such a resistor when it is formed on a bare ceramic substrate having no intermediate underglaze, although not to so serious an extent. This leaves a gap, or at least a high resistance contact between the termination and the resistor film. This degredation of the termination is frequently accompanied by large cracks in the termination which in many cases cause it to become electrically open. The coating and firing of an overglaze may have a similar effect, it having been noted that the thin film termination floats in or even on top of the overglaze.

It is therefore an object of this invention to provide a sub-micron film termination in a resistor having a glass containing resistive element.

It is a further object of this invention to provide a low cost termination in a resistor having a glass containing resistor element.

It is a further object of this invention to provide a reliable sub-micron resistor termination that is covered with low temperature overglaze.

SUMMARY OF THE INVENTION

A resistor is formed on an insulating substrate having metal film terminations. A resistor layer of the conventional cermet type contains glass and conductive material that may be metal or metal oxide or mixtures thereof. The resistor glass is preferably a low temperature glass containing an oxide selected from $Bi_2O_3$, CdO, PbO or mixtures thereof. These oxides are among known ingredients of glasses that depress the melting temperature from that of glasses containing only the so-called glass formers such as silica and boron oxide. The glass containing resistor layer of this invention has distal portions lying in contact with the metal film terminations. These terminations contain particles of silica or of manganese dioxide to reduce the residual stresses normally remaining after firing. The terminations preferably contain more than 20% by weight of the silica or more than 17% of the $MnO_2$ to improve the resistor-to-termination junction. This improvement is realized whether the resistor is formed on a glazed or an unglazed substrate, and is independent of the metals used in the terminations or cermet resistor layer. It is further independent of the glass that is employed in the resistor layer, leaving the choice of the cermet resistor layer composition entirely open for determining and adjusting the resistor performance as may be desired. For the first time it becomes practical to manufacture a wide variety of cermet resistors having sub-micron film terminations which results in substantial cost savings.

The resistor of this invention is made by forming on a substrate sub-micron metal film terminations containing particles selected from silica and manganese dioxide, and depositing thereover a glass containing resistor layer. Both the film terminations and resistor layer are preferably formed by sequentially screen printing noble metal resinate containing pastes and firing, the termination paste containing the silica or manganese dioxide particles, and the resistor paste containing a low temperature glass frit.

DESCRIPTION OF THE PREFERRED EMBODIMENTS

Figure 1:
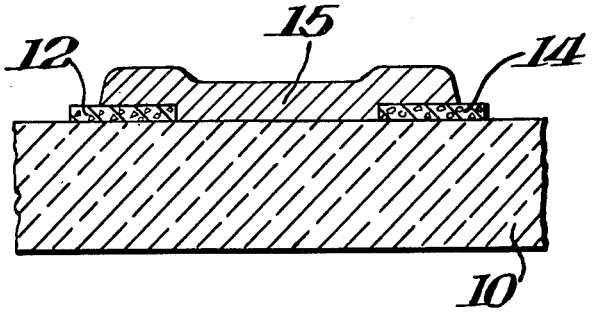
FIG. 1 shows a sectional view of a first cermet resistor of this invention.
Figure 2:
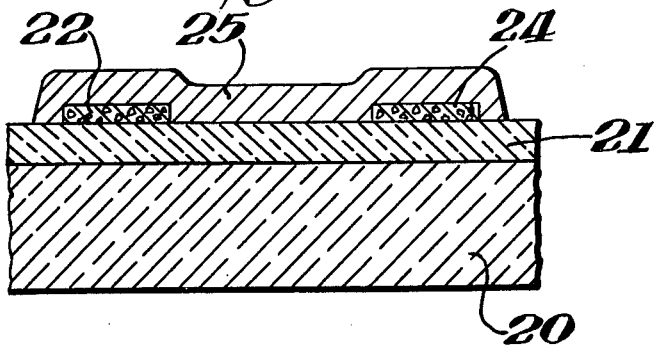
FIG. 2 shows a sectional view of a second cermet resistor of this invention on a glazed substrate, the resistor layer overlapping and covering the terminations.

In the sectional view of FIG. 1 there is shown a first resistor of this invention without an underglaze. A ceramic substrate 10 has formed thereon metal film terminations 12 and 14. A glass containing resistor layer 15 is shown overlapping the terminations. Data is given in Table III pertaining to such resistors (samples 14 and 15) as will be described later herein. FIG. 2 shows a substrate 20 with a glaze coating 21, the terminations 22 and 24 and the overlapping resistor layer 25 being formed thereover. The glassy layer 25 covers and protects the terminations particularly from subsequent solder steps. The results of six experiments are shown in Table I below.

Figure 3:
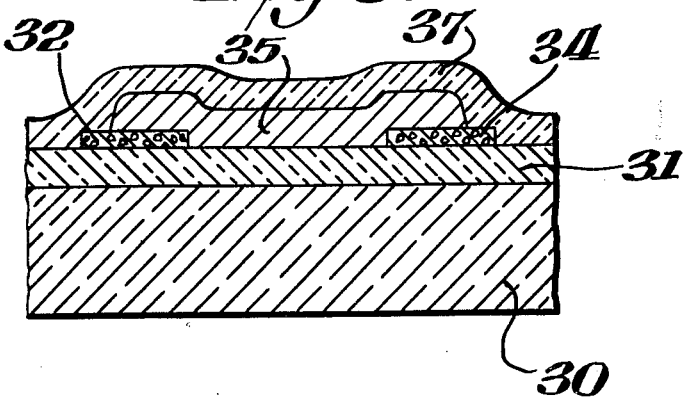
FIG. 3 shows a sectional view of a third cermet resistor of this invention with a substrate having a glaze coating.

FIG. 3 shows a third resistor of this invention having a substrate 30, a glaze coating 31, terminations 32 and 34, a cermet resistor layer 35 and a low temperature overglaze coating 37 that covers and protects exposed portions of the terminations 32 and 34. The experimental resistors for which data is presented herein generally have the structure of FIG. 1 either with or without a substrate glaze coating such as coating 21 as seen in FIG. 2.

In a search for an additive to the termination paste that would ameliorate or relieve the aforementioned stresses in a fired sub-micron thick film termination, a series of experiments were performed. All of the experiments, for which data is presented herein, were conducted according to the method described below, with exceptions as specifically noted.

A layer of lead aluminosilicate glass frit was screen-printed on 96% $Al_2O_3$ substrates and fired at 1900° F for 15 minutes to produce a smooth non-porous surface. This underglaze characteristically softens to a stiff putty-like consistency at 1600° F. A termination paste was comprised of a gelled resinate solution containing 15% Au, 2% Pt and 0.24% Bi. For most of the experiments, various candidate powder additives were included in the termination paste, the quantities and nature of which is described in a later description of the individual experiments.

The termination paste mixture was hand stirred and then passed three times through a three-roll mill to assure adequate particle distribution. The resulting mixture was screen-printed onto the glazed substrates using a 200 mesh stainless steel screen and fired at 1650° F for 10 minutes. A commonly used resistor paste consisting of lead borosilicate glass and platinum-iridium resinate was then screen-printed on the substrates so as to overlap the termination pattern, and was fired at 1580° F for 10 minutes. The relative quantities of glass and resinate in the resistor paste were selected to yield a fired film of 97.25% glass and 2.75% platinum-iridium alloy containing approximately equal amounts of the two metals.

In Table I the percentages by weight of the constituents are rounded to the nearest 1%. Percent gold in the terminations changes in each sample. The same resinate was used in samples 1 through 6, but with different quantities of powder.

Table I

| Sample No. | Termination Compositions | | | Additive | Junction Quality | Resistivity (Ohms/square) |
|---|---|---|---|---|---|---|
| 1 | 87 Au | 12 Pt | 1.0 Bi | | 1 | 0.7 |
| 2 | 79 Au | 10 Pt | 1.0 Bi | $10TiO_2$ | 3 | 1.2 |
| 3 | 68 Au | 9 Pt | 1.0 Bi | $22TiO_2$ | 10 | ∞ |
| 4 | 68 Au | 9 Pt | 1.0 Bi | $22Al_2O_3$ | 3 | 7 |
| 5 | 68 Au | 9 Pt | 1.0 Bi | $22SiO_2$ | 5 | 1.5 |
| 6 | 68 Au | 9 Pt | 1.0 Bi | $22SiO_2$ | 8 | ∞ |

The numbers in the column labled junction quality represent estimates of junction quality as visually determined by use of a 90 power microscope, the quality ranging from very poor (1) to excellent (10). The basis on which the junction quality was judged included the size and density of cracks that appeared in the portion of the termination that lay underneath the overlapping resistor layer. The relatively thick glass-containing resistor layer was composed of platinum and iridium, and the glass being 66%PbO 22.7%$SiO_2$ 8.5%$B_2O_3$ 2.8%$Al_2O_3$, this resistor layer being sufficiently transparent to make possible the inspection of the underlying termination junction.

The junction quality as designated by the number 5, corresponds to there being a dense pattern of hairline cracks (as observed at 90 power magnification). For resistors having a junction quality of 5 or above, the overall stability of these resistors was always satisfactory as determined by short term overload and load life tests. For resistors having a junction quality of 4 or less, short term overload tests indicate unreliable performance.

The resistivity of the termination films was measured in a region of the film not overlapped by the resistor layer, by means of a standard probe measurement technique.

Regarding the resistivity of the termination films, it is generally true that lower resistivities are the most desirable. More practically, how low the resistivity of a termination film should be in a given resistor is dependent upon the particular geometry of the termination and the resistor as well as the resistivity of the resistor layer. For example, 100 ohm resistors should usually include a termination having a resistance of less than about 1 ohm. Most film resistors being manufactured today employ a termination film whose sheet resistivity is less than 10 ohms per square. Obviously a termination system providing on the order of 1 ohm per square is desirable as being more universally usable.

From the data shown in Table I, it is seen that the best results were obtained in example 5. Junction quality is acceptable and the resistivity at 1.5 ohms per square is low. None of the terminations in the other examples are acceptable. Sample 1 exemplifies the junction quality problem that needed solving. Addition of 10% $TiO_2$ in example 2 improved the quality somewhat while raising resistivity as would be expected. But in Sample 3, a 22% addition of titania produced excellent junction quality but the termination became nonconducting, indicating that at best a carefully controlled intermediate quantity of titania additive would provide only a moderately good junction quality and a moderately high resistivity.

In Sample 4, alumina was added in the same quantity for which a silica additive was found effective in Sample 5. The result was an unsatisfactory junction quality. A lesser quantity of alumina would clearly produce a lower quality junction while a greater quantity would produce an even higher resistivity. Alumina is thus an unsatisfactory additive.

The titania, alumina, and silica additives used in samples 2, 3, 4 and 5 were in powder form, the average particle size being about 0.5 to 1.5 microns in each example. Sample 6 employs a much finer silica, namely CABOSIL (Fluffy Colloidal Grade) a trade name of Cabot Corp., Boston, Mass., that produces a good junction quality but a nonconducting film. Clearly there is a minimum silica particle size that is effective as an additive in producing a useful resistor termination film. The silica of Sample 5 has particle sizes ranging from about 0.2 to 1.0 microns as supplied by Cotronics Corporation, 37A W. 39th St., New York, N.Y., and from the data presented it is judged that the minimum average particle size of an effective silica additive is about 0.2 micron.

In order to determine the quantities of silica additive that would be effective as an additive in the termination, additional experiments were performed using the aforementioned Cotronics material. The results of these additional experiments are shown in Table II along with results of Samples 1 and 5 for comparison.

Table II

| Sample No. | Termination Compositions | | | Additive | Junction Quality | Resistivity (ohms/square) |
|---|---|---|---|---|---|---|
| 1 | 87 Au | 12 Pt | 1.0 Bi | 0 | 1 | 0.7 |
| 7 | 72 Au | 10 Pt | 1.0 Bi | 17 $SiO_2$ | 2 | 1.3 |
| 5 | 68 Au | 9 Pt | 1.0 Bi | 22 $SiO_2$ | 5 | 1.5 |
| 8 | 61 Au | 8 Pt | 1.0 Bi | 30 $SiO_2$ | 6 | 6.0 |

It was thus determined that no less than 20% by weight of silica would be adequate in the fired termination to provide a satisfactory resistor junction quality.

In further experiments following those described above, resistors were made without particle additives in the termination paste, by the aforementioned process except that an attempt was made to expose the resistor at firing to a richer oxygen atmosphere. It is accepted theory that bonds between metal oxides in a metal conductor and the oxides of the underlying ceramic or glass depend on oxygen linkages at the interface, so a greater flow of air was introduced into the firing kiln to achieve the more oxygen rich atmosphere. No improvements in bonding were observed.

Subsequently manganese dioxide particles were mixed into the termination paste to see if in addition to relieving the stresses, the highly reducible $MnO_2$ might give up some of its oxygen in the critical termination-substrate interface region and promote an improved bond. This experiment was successful as the data from additional examples in Table III indicates. Not only did the $MnO_2$ particles cause the formation of tension relieving microcracks in the terminations, but the adherence of the terminations to the substrate was significantly enhanced. Furthermore, the quantities of the $MnO_2$ particles additive that are necessary to produce these results produces a termination film that exhibits a lower sheet resistivity than for terminations containing the silica particles. Sample 1 is again included in Table III for ease of comparison.

Table III

| Sample No. | Termination Compositions | | | Additive | Junction Quality | Resistivity (ohms/square) |
|---|---|---|---|---|---|---|
| 1 | 87 Au | 12 Pt | 1.0 Bi | 0 | 1 | 0.7 |
| 9 | 72 Au | 10 Pt | 1.0 Bi | 17 $MnO_2$ | 5 | 0.75 |
| 10 | 68 Au | 9 Pt | 1.0 Bi | 22 $MnO_2$ | 9 | 0.8 |
| 11 | 61 Au | 8 Pt | 1.0 Bi | 30 $MnO_2$ | 9 | 1.7 |
| 12 | 55 Au | 7 Pt | 1.0 Bi | 37 $MnO_2$ | 10 | 4.2 |
| 13 | 68 Au | 9 Pt | 1.0 Bi | 22 $MnO_2$ | 9 | 0.8 |
| 14 | 68 Au | 9 Pt | 1.0 Bi | 22 $MnO_2$ | 9 | 2.0 |
| 15 | 87 Au | 12 Pt | 1.0 Bi | 0 | 3 | 1.2 |
| 16 | 28 Pd | 72 Ag | 0.1 Rh | 0 | 3 | 1.5 |
| 17 | 23 Pd | 59 Ag | 0.1 Rh | 18 $MnO_2$ | 9 | 4.0 |
| 18 | 61 Au | 8 Pt | 1.0 Bi | 30 $MnO_2$ | 10 | 6 |
| 19 | 63 Au | 8 Pt | 1.0 Bi | | | |
| | | 28 Glass | | 0 | 5 | 2.5 |
| 20 | 52 Au | 7 Pt | 1.0 Bi | | | |
| | | 23 Glass | | 17 $MnO_2$ | 9 | 4.0 |

From samples 1, 9, 10, 11 and 12, it is clear that acceptable junction quality can be achieved by adding at least 17% $MnO_2$ particles to the termination while in comparison with terminations having silica particles the resistivity of the comparable samples in Table III is significantly lower. In addition to the improved termination to substrate bond that results from the chemical reaction with $MnO_2$ particles, the generally superior performance of the $MnO_2$ containing terminations relative to those containing $SiO_2$, especially the low resistivity, is attributed to the fact that for the same quantities of these two additives the volume of $SiO_2$ is about double that of $MnO_2$, their densities being 2.3 and 5 gm/cc respectively. Thus the better bonded $MnO_2$ containing terminations having less volume of particles, tend to shrink less, to crack less, to have better physical continuity and lower resistivity.

In all the samples discussed thus far, the termination was formed on a glazed ceramic substrate. In samples 14 and 15, no underglaze was present, the resistors being formed on a bare alumina substrate. With no additive in the termination of sample 15, the junction quality is poor, though in comparison with sample 1, junction quality is moderately better and resistivity somewhat higher as would be expected considering the much rougher surface of the unglazed bare alumina substrate. However, in sample 14 the termination with $MnO_2$ added that is formed on a base substrate, provides excellent junction quality and a reasonably low resistivity.

In samples 16 and 17, palladium and silver are substituted for the previously used gold and platinum metals in the termination paste. In sample 16 the termination does not contain particle additives whereas in sample 17 the termination contains 18% $MnO_2$ particles (Baker 8392). The efficiency of the $MnO_2$ additive is independent of the metals contained in the termination.

Samples 19 and 20 show data for a resistor having terminations containing 28% glass and no $MnO_2$, and another similar one wherein 17% by weight of $MnO_2$ particles have been added in the termination. The results show that a glass containing termination without the particles has a fairly good quality junction while the one to which particles of $MnO_2$ have been added provides a substantially improved junction quality. The termination of sample 19 had a thickness of about 0.6 micron while the average termination thickness of sample 20 was about 1.1 microns. Thus the maximum amount of glass that can be contained in a sub-micron termination film of this invention is about 22 percent by weight.

In Table IV there are shown results from experimental resistors that have different resistor layer compositions. For the resistor samples represented in Table IV, those that have no particle additives in the terminations have termination compositions of 87%Au, 12%Pt, and 1%Bi. For those that have particle additives in the terminations, the termination composition is 68%Au, 9%Pt, 1%Bi and 22%$MnO_2$ (Baker 8392). Data of previously discussed samples 1 and 10 are included for ease in making comparisons.

Table IV

| Sample No. | Termination Additive | Resistor Layer Composition | Junction Quality | | Resistivity (ohms/square) |
|---|---|---|---|---|---|
| 1 | | Pt;Ir;66PbO 22.7$SiO_2$ 8.5$B_2O_3$ | 2.8$Al_2O_3$ | 1 | 0.7 |
| 10 | 22%$MnO_2$ | " | | 9 | 0.8 |
| 21 | 0 | Ru;50$Bi_2O_3$ 40CdO 10$B_2O_3$ | | 3 | 0.7 |
| 22 | 22%$MnO_2$ | " | | 9 | 0.8 |
| 23 | 0 | Ru;72.6BaO 12.1$Al_2O_3$ 8.2$B_2O_3$ | 7.1$SiO_2$ | 4 | 0.7 |
| 24 | 22%$MnO_2$ | " | | 9 | 0.8 |
| 25 | 0 | Ru;90$Bi_2O_3$ 10$B_2O_3$ | | 1 | 0.7 |
| 26 | 22%$MnO_2$ | " | | 9 | 0.8 |

The performance of samples 1, 21, 23 and 25 clearly illustrates the problem that has heretofore prevented the use of low cost glass free terminations with overlapped resistor layers containing a wide variety of low temperature glasses. Samples 10, 22, 24 and 26 on the other hand show how the use of $MnO_2$ additives in the terminations solves this problem and permits the choice of resistor layer glass to be made solely on the basis of what resistor layer compositions will give the desired resistor performance such as resistivity and temperature coefficient of resistance.

It has been noted that to be effective, the average particle size of silica powder additives must be 0.2 micron or larger. Returning to the data of Table III, samples 9, 10, 11 and 12 employ the aforementioned $MnO_2$ powder, designated Baker 8392, having an average particle size of about 20 microns and containing particles larger than 40 microns. In sample 13, the additive was No. 6133 $MnO_2$ powder supplied by Mallinckrodt Chemical Works, St. Louis, Missouri, having an average particle size of about 1 micron. Further in sample 18 the additive was an $MnO_2$ powder having an average particle size of about 100 angstroms, which size is commensurate with the size of the $MnO_2$ molecules. It is clear from the data that any particle size of the $MnO_2$ additive in the termination is effective to improve the termination to resistor layer junction quality.

The maximum particle size that can be effectively used according to this invention has been found to be limited only by the size of screen mesh openings. Termination films derived from the screened resinate method and without glass as described herein are generally about 2000 angstroms thick and effective particle additives may have diameters many times as large as the average film thickness.

In cross section, the fine metallic webs of metallo-organic derived glass containing films provide a reliable identification by which such films may be distinguished from those formed by any other known means. For example, in cross section a glass-metal film having been prepared by depositing on a substrate a paste containing metal particles and glass frit and sinter firing, reveals under the microscope the contours of the individual metal particles that are sinter fused to other and adjacent metal particles.

Although in the experimental work described herein, the resistor terminations of this invention have been shown to contain either silica or manganese dioxide particles, it is clear that mixtures of silica and manganese dioxide particles in the termination would be effective and so should be considered to fall within the scope of this invention.

What is claimed is:

1. A resistor comprising an insulating substrate; sub-micron noble metal film terminations being bonded to said substrate; a glass containing resistor layer, distal portions of said resistor layer having overlapping contact with said terminations; and manganese dioxide particles being contained in and constituting at least 17 weight percent of said terminations thereby reducing residual stresses in said terminations and improving the quality of the junction between said terminations and said resistor layer.

2. The resistor of claim 1 wherein said resistor layer glass is a low temperature glass containing metal oxides selected from $Bi_2O_3$, CdO, PbO and mixtures thereof.

3. The resistor of claim 1 wherein said substrate is a ceramic material.

4. The resistor of claim 1 wherein said substrate is alumina having a smooth glaze coating thereon.

5. The resistor of claim 1 wherein said metal film terminations are comprised of a resinate derived noble metal.

6. The resistor of claim 1 wherein said sub-micron film terminations contain up to 22% by weight of glass.

7. The resistor of claim 1 wherein said terminations additionally include particles of silica.

* * * * *